US006338585B1

(12) United States Patent
Amano

(10) Patent No.: US 6,338,585 B1
(45) **Date of Patent: *Jan. 15, 2002**

(54) SHEET CONTAINING CASSETTE

(75) Inventor: Masao Amano, Susono (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/063,404

(22) Filed: Apr. 21, 1998

(30) Foreign Application Priority Data

Apr. 24, 1997 (JP) ..... 9-107766

(51) Int. Cl.[7] ..... B41J 11/58
(52) U.S. Cl. ..... 400/624; 399/393
(58) Field of Search ..... 400/624, 634, 400/631, 647; 399/393; 271/101, 110, 126, 127, 148, 171

(56) References Cited

U.S. PATENT DOCUMENTS 4,240,757 A * 12/1980 Hanna ..... 400/196.1
4,569,587 A * 2/1986 Miyoshi et al. ..... 355/72
4,770,555 A * 9/1988 Deschamps et al. ..... 400/624
5,313,257 A * 5/1994 Kashima et al. ..... 355/309
5,419,645 A * 5/1995 Russo ..... 400/624
5,738,452 A * 4/1998 Uchida ..... 400/624
5,765,091 A * 6/1998 Kavach et al. ..... 399/393
5,829,898 A * 11/1998 Hill et al. ..... 400/624
5,895,040 A * 4/1999 Oleksa et al. ..... 271/124
5,996,989 A * 12/1999 Cahill et al. ..... 271/121
6,065,586 A * 5/2000 Embry et al. ..... 400/629
6,010,261 A * 12/2000 Maekawa ..... 400/605

* cited by examiner

*Primary Examiner*—John S. Hilten
*Assistant Examiner*—Darius N. Cone
(74) *Attorney, Agent, or Firm*—Fitzpatrick, Cella, Harper & Scinto

(57) ABSTRACT

The present invention provides a sheet containing cassette detachably mounted on a main body of an image forming apparatus to contain sheets to be supplied by a sheet supply means provided in the apparatus body, the cassette comprising a frame member, a sheet supporting member disposed within the frame member and adapted to support the sheets to be supplied by the sheet supply means, and a separation sheet provided on the sheet supporting member in an opposed relation to the sheet supply means. Character and/or a sketch are described on the separation sheet.

12 Claims, 6 Drawing Sheets

SHEET CONTAINING CASSETTE

BACKGROUND OF THE INVENTION

1. Field of the Invention

The present invention relates to a sheet containing cassette, a sheet supplying apparatus having such a cassette and an image forming apparatus having such a cassette.

2. Related Background Art

Many image forming apparatuses include a sheet supplying apparatus for supplying a transfer material. In such a sheet supplying apparatus, various sheet supplying systems and sheet separating systems can be used. Further, there are many kinds of cassettes for containing sheets. For example, in some conventional sheet containing cassettes, a label on which an operation method was pictured is adhered to a predetermined portion of the cassette.

As color printers have recently progressed, there is a need for application of various media (recording materials) to the sheet supplying apparatus. On the other hand, in the market, further reduction of the price of products has also been required. Further, there is a need for improvement in operability (for example, sheet setting ability) has also been required while satisfying the above-mentioned requests.

SUMMARY OF THE INVENTION

An object of the present invention is to provide a cheap sheet containing cassette in which correspondence to various media and operability are excellent, and a sheet supplying apparatus and an image forming apparatus which include such a sheet containing cassette.

Another object of the present invention is to provide a sheet containing cassette detachably mounted on a main body of an image forming apparatus to contain sheets to be supplied by a sheet supply means provided on the main body, the cassette comprising a frame member, a sheet supporting member disposed within the frame member to support the sheets to be supplied by the sheet supply means, and a separation sheet provided on the sheet supporting member in an opposed relation to the sheet supply means. Here, characters and/or a sketch are described on the separation sheet.

DETAILED DESCRIPTION OF PREFERRED EMBODIMENTS

Figure 1:
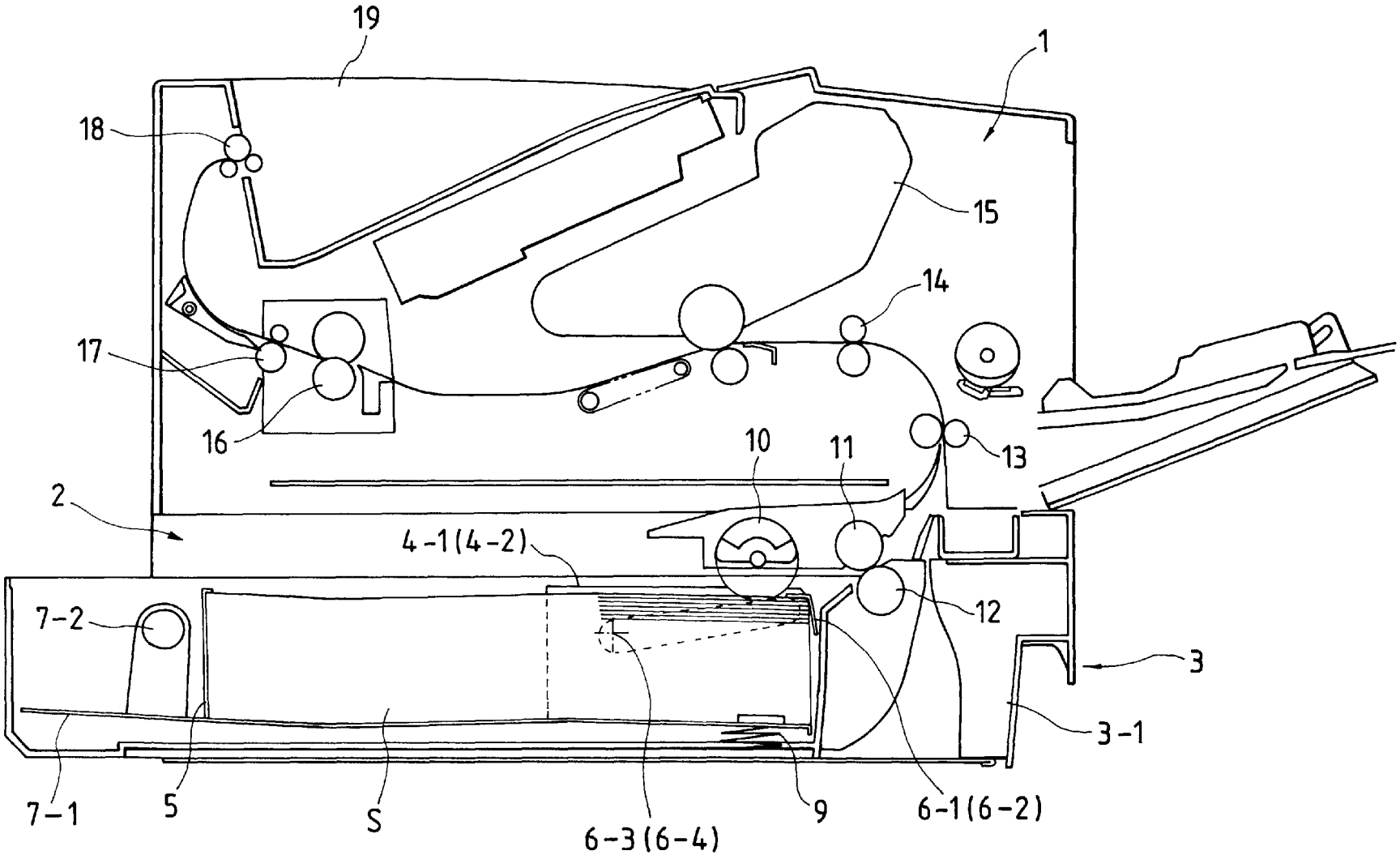
FIG. 1 is a schematic view of an image forming apparatus according to a preferred embodiment of the present invention.

Now, embodiments of the present invention will be explained with reference to the accompanying drawings.

[First Embodiment]

In an image forming apparatus according to a first embodiment of the present invention, mainly, a sheet containing device, and particularly, a sheet containing cassette 3 is described.

First, the image forming apparatus 1 will be briefly described, and the sheet containing cassette 3 will be fully described later.

When a sheet supply signal is outputted from a controller (not shown), a pick-up roller (sheet supply means) 10 is rotated to pick up sheets S contained in the sheet containing cassette 3 of a sheet supplying apparatus 2. After a predetermined time period is elapsed, a feed roller 11 and a retard (retract) roller 12 are rotated in predetermined directions, respectively, to separate only a single sheet from the picked-up sheets. Then, the separated sheet is conveyed by pairs of convey rollers 13, 14 along a predetermined convey path.

While the sheet is being conveyed, a toner image is transferred onto the sheet in an image forming portion 15. Thereafter, the toner image is fixed to the sheet by a fixing device 16. Ultimately, the sheet is discharged from the image forming apparatus 1 onto a discharge portion 19 by convey rollers 17, 18.

In the image forming apparatus 1, a duplex unit 30 can be mounted above the sheet supplying apparatus 2. The brief explanation of the image forming apparatus 1 is completed.

Now, the sheet containing cassette (sheet supporting means) 3 which is the characteristic of the present invention will be mainly explained.

Figure 2:
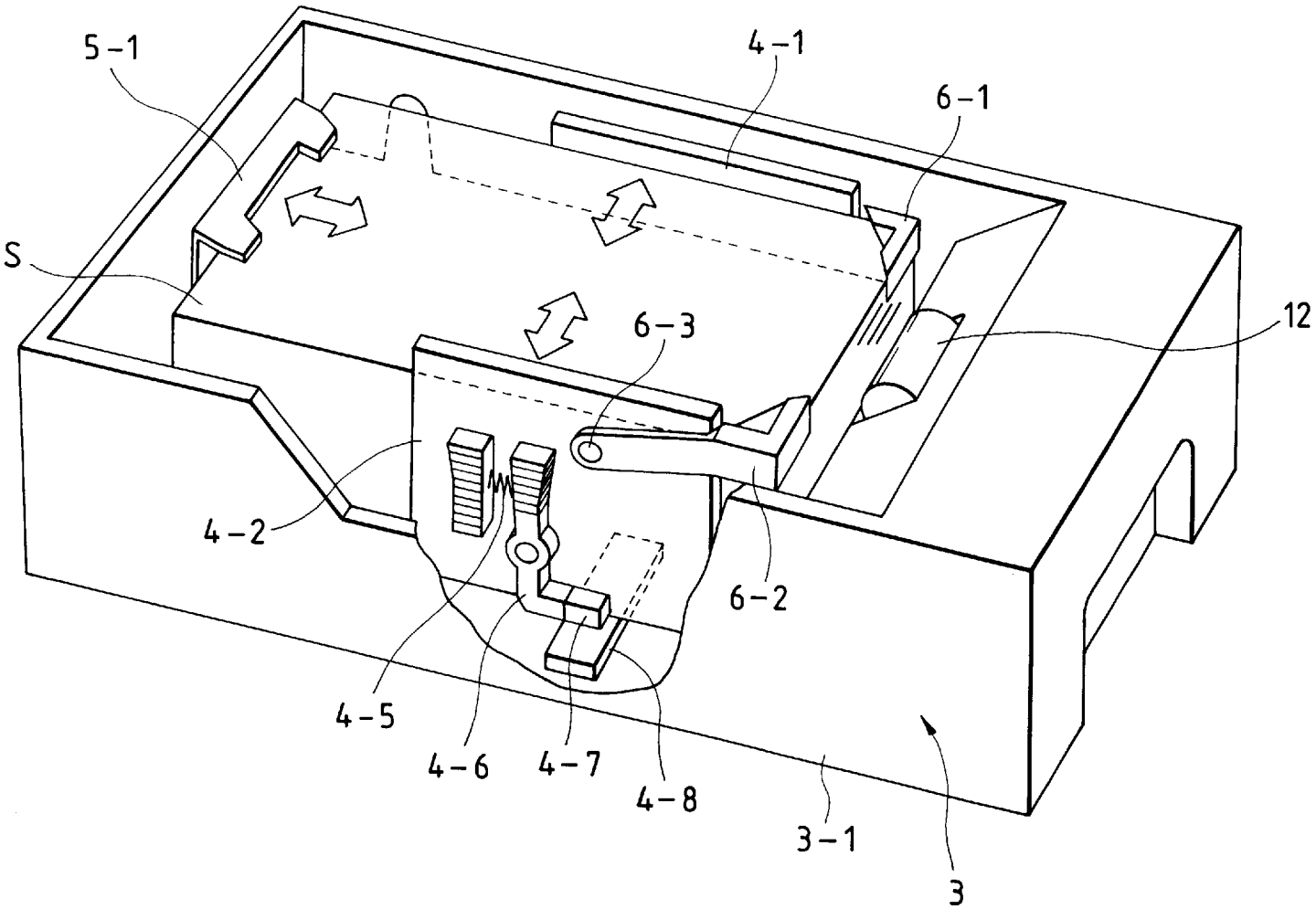
FIG. 2 is a perspective view of a sheet containing cassette according to the present invention.
Figure 3:
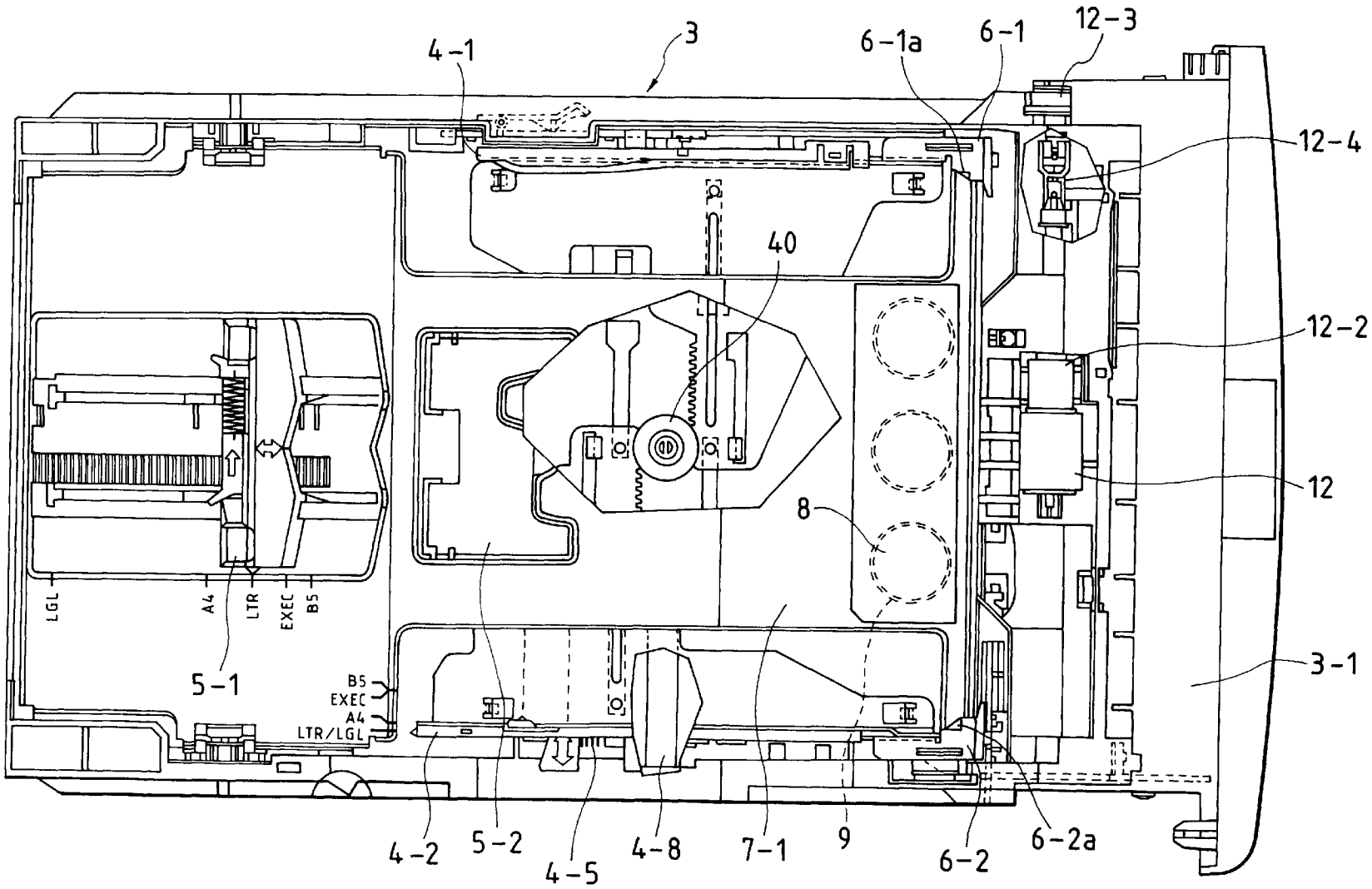
FIG. 3 is a plan view of the sheet containing cassette.

FIG. 2 is a perspective view of the sheet containing cassette 3, and FIG. 3 is a plan view of the sheet containing cassette.

The sheet containing cassette 3 is detachably mounted to the image forming apparatus 1. The sheet containing cassette 3 includes a box-shaped frame member 3-1 within which width regulating plates 4-1, 4-2, trail end regulating members 5-1, 5-2, sheet hold-down members 6-1, 6-2, an intermediate plate 7-1, a separation sheet 8 and a retard roller 12 are disposed.

The width regulating plates 4-1, 4-2 serve to regulate position of the sheets S stacked and contained in the sheet containing cassette 3 in a left-and-right direction. In order to cope with sheets having various sizes, a distance between the width regulating plates 4-1 and 4-2 can be changed. Further, the width regulating plates 4-1, 4-2 can be locked at a desired distance position. A concrete mechanism for changing the distance and locking the width regulating plates is as follows.

As shown in FIG. 3, the width regulating plates 4-1, 4-2 have bottom plates having racks formed thereon. The racks are engaged by a pinion gear 40 on both sides. With this arrangement, when one of the width regulating plates 4-1, 4-2 is slid in a width-wise direction by a predetermined amount, the other width regulating plate is slid in an opposite direction by the same amount, thereby adjusting the distance between the plates. Incidentally, regarding fixed-form sizes such as A4 size, B5 size and the like, the operator can know setting positions thereof by click feeling.

As shown in FIG. 2, the width regulating plates 4-1, 4-2 are locked by urging a rubber bushing 4-7 provided on an end of a lever 4-6 attached to the width regulating plate 4-1 against a rubber sheet 4-8 adhered to a bottom of the sheet containing cassette 3. The urging can be effected by biasing the lever 4-6 by means of a biasing spring 4-5.

The intermediate plate 7-1 serves to hold the sheet stacked thereon. In order to pick up the sheets by means of the pick-up roller 10 (FIG. 1), the sheet stack must be urged against the pick-up roller 10. To this end, the intermediate plate 7-1 is supported for rocking movement around a shaft 7-2 upwardly and downwardly and is always biased upwardly by biasing springs 9 (FIGS. 1 and 3).

Figure 4:
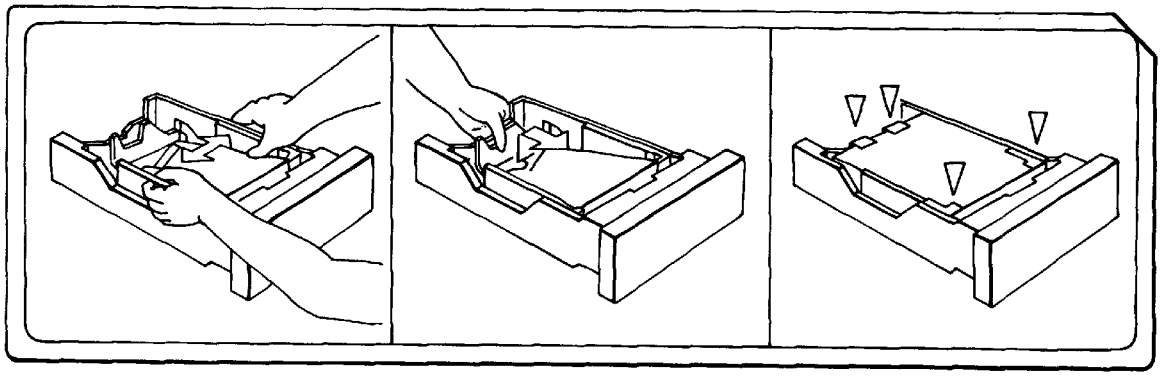
FIG. 4 is a view showing an example of sketches described on a separation sheet.

The separation sheet 8 serves to assist the picking-up of the sheets effected by the pick-up roller 10 and is adhered to the intermediate plate 7-1 in an opposed relation to the pick-up roller 10. Desired sketches and/or characters (in the illustrated embodiment, pictures showing an operation method for setting the sheets in the sheet containing cassette; see FIG. 4) are printed on the separation sheet 8.

As a practical matter, the material of the separation sheet 8 must satisfy the following conditions (i) to (iv).

(i) The material is transparent (or translucent).

In order to prevent the printed sketches from disappearing due to wear, it is desirable that the sketches are printed on a back surface of the separation sheet. When this is done, it is necessary that the printed sketches can be seen from a front side.

(ii) The material has excellent durability.

(iii) The material has a stable coefficient of friction to the sheet.

(iv) The material is inexpensive.

Concretely, the separation sheet 8 according to the illustrated embodiment is formed from elastomer sheet of urethane group. However, so long as the elastomer sheet is used, the above-mentioned conditions are satisfied, even if the urethane group is not used. In order to prevent the reduction of the coefficient of friction due to adhesion of paper powder and the like, grain is formed on the surface of the separation sheet 8 so that surface roughness becomes 5 to 20 $\mu$m. The thickness of the separation sheet is selected to be about 200 $\mu$m which is much smaller than the conventional thickness (about 1 mm).

The sheet hold-down members 6-1, 6-2 serve to regulate a height position (level) of the sheet stack to prevent the tip end of the sheet stack from lifting excessively. The sheet hold-down members 6-1, 6-2 are attached to the width regulating plates 4-1, 4-2 for rocking movement around shafts 6-3, 6-4 upwardly and downwardly.

Figure 5:
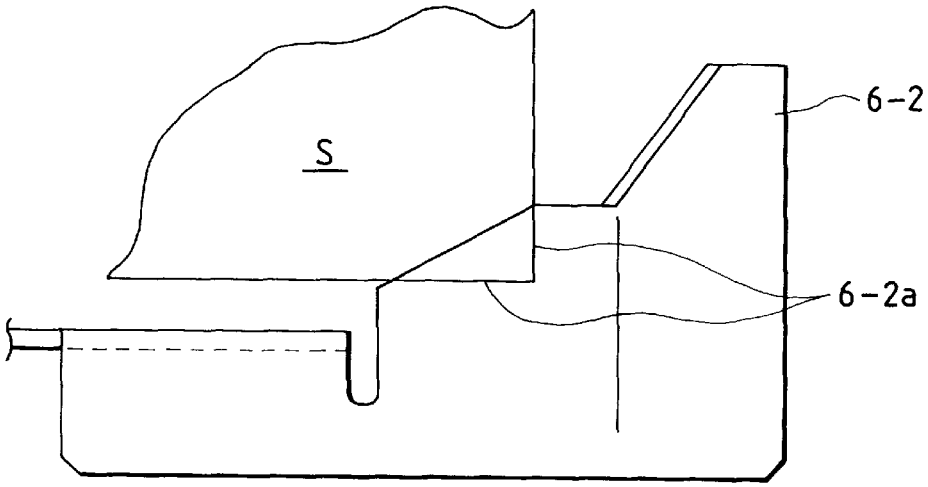
FIG. 5 is a view showing marks formed on a sheet hold-down member.

The sheet hold-down members 6-1, 6-2 according to the illustrated embodiment are provided with marks 6-1*a*, 6-2*a* (FIG. 5) for indicating a position (proper position) to which the sheets are set. In the illustrated embodiment, the marks 6-1*a*, 6-2*a* represent a corner position of the sheet and an outline position of the sheet. Accordingly, it can be prevented that the distance between the width regulating plates 4-1 and 4-2 is set to be narrower than the width of the sheets to be contained to thereby cause poor sheet supply.

In the illustrated embodiment, the marks 6-1*a*, 6-2*a* are formed by stamping. However, the marks are sufficient to be easily recognized by the operator. Accordingly, the marks 6-1*a*, 6-2*a* may be formed by an appropriate technique other than the stamping. For example, the marks may be formed by marked lines. Alternatively, the marks may be represented by utilizing stepped portions.

The trail end regulating members 5-1, 5-2 serve to regulate the trail end of the sheet. A position of the trail end regulating member 5-1 in a sheet supplying direction can be changed in order to accommodate various sheets having different sizes. The position of the trail end regulating member 5-1 can freely be changed within a range between a position P1 and a position P2 in FIG. 6.

Figure 6:
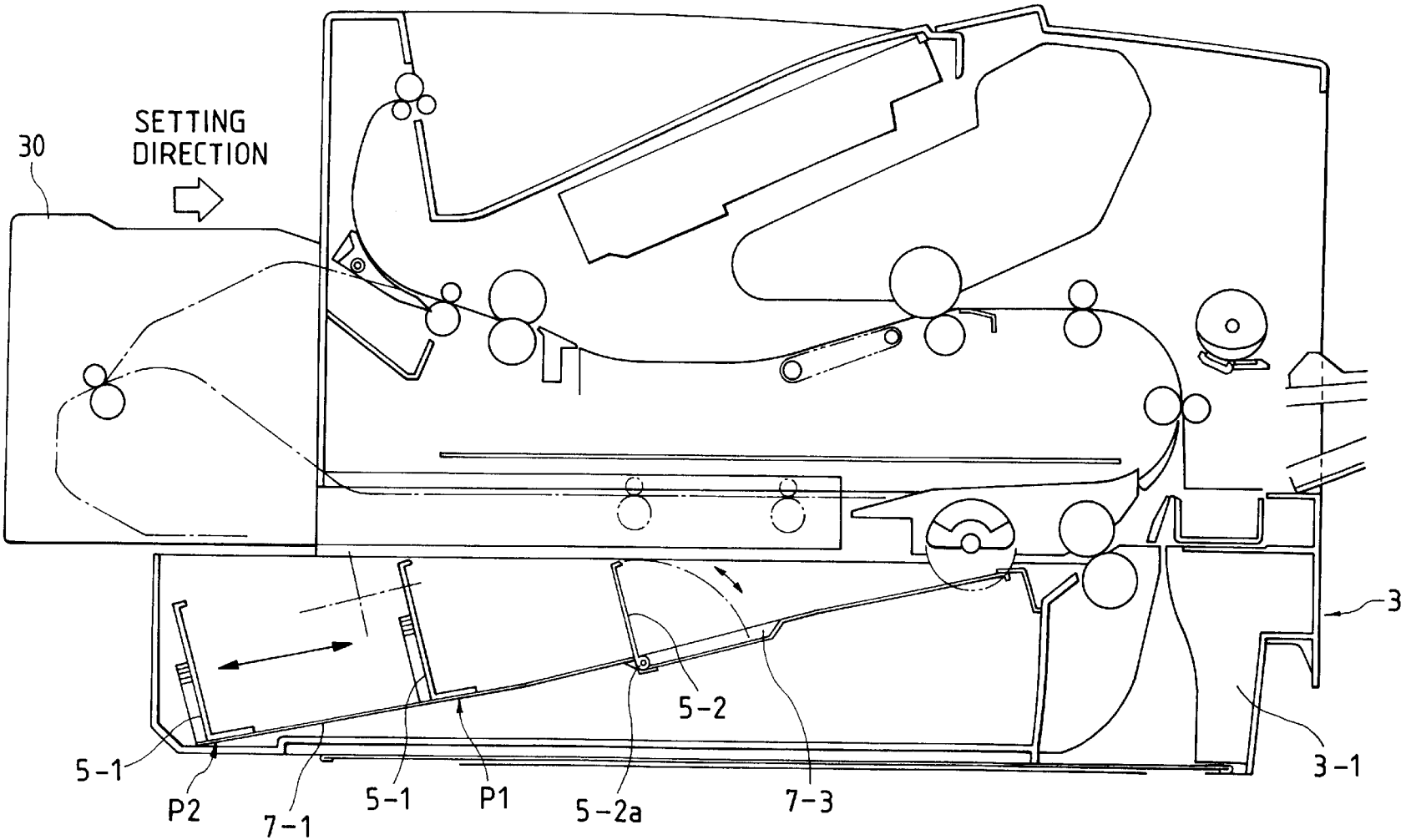
FIG. 6 is a view showing an application condition of trail end regulating plates 5-1 and 5-2.

The trail end regulating member 5-2 is provided for accommodating small size sheets (in the illustrated embodiment, sheets having sizes smaller than A5 size). The trail end regulating member 5-2 is disposed within a recess 7-3 formed in the intermediate plate 7-1 for rocking movement around a lower shaft 5-2*a*. When the trail end regulating member 5-2 is laid, the trail end regulating member 5-2 can be contained within the recess 7-3 (FIG. 6). Accordingly, an inoperative condition, the trail end regulating member 5-2 does not interfere with other elements during the stacking of the sheets.

Since the intermediate plate 7-1 is biased upwardly, in a condition that the number of sheets contained in the cassette is small, the trail end regulating members 5-1, 5-2 are elevated. In this case, if upper ends of the trail end regulating members 5-1, 5-2 are protruded upwardly from the sheet containing cassette 3, there is a danger of damaging the trail end regulating members by striking them against other elements during the mounting/dismounting of the sheet containing cassette 3. To avoid this, the heights of the trail end regulating members 5-1, 5-2 are selected so that, even when the intermediate plate 7-1 reaches an uppermost position, the upper ends of the trail end regulating members 5-1, 5-2 are not protruded upwardly from the sheet containing cassette 3. Accordingly, in the illustrated embodiment, even when the both-face unit 30 is mounted on the image forming apparatus 1 to reduce the space above the sheet containing cassette 3, there is no danger of damaging the apparatus. Incidentally, the height of the trail end regulating member 5-2 is reduced with respect to the height of the trail end regulating member 5-1 since the trail end regulating member 5-2 is positioned forwardly of the trail end regulating member 5-1. In this regard, a sheet containing amount when the trail end regulating member 5-2 is used is smaller than a sheet containing amount when the trail end regulating member 5-1 is used (i.e., about 80%).

The retard roller 12 serves to separate the sheets during the sheet supplying operation by operating in synchronous with the feed roller 11 of the image forming apparatus. The retard roller 12 is urged against the feed roller 11 when the sheet containing cassette 3 is mounted on the image forming apparatus 1.

The retard roller 12 is driven by transmitting a driving force inputted from the image forming apparatus to the retard roller 12 through a pendulum gear (not shown), a gear 12-3, a joint 12-4 and a torque limiter 12-2. That is to say, in the condition that the sheet containing cassette 3 is mounted on the image forming apparatus 1, the gear 12-3 is always driven in a direction opposite to the sheet conveying direction by the pendulum gear provided in the sheet supplying apparatus. The driving force from the gear 12-3 is transmitted to the retard roller 12 through the joint 12-4 and the torque limiter 12-2.

As mentioned above, the sheet containing cassette and the sheet supplying apparatus according to the illustrated embodiment can handle various sheets having different sizes.

Further, since the reference position indicators (marks) for aiding the positioning of the sheets are provided on the sheet hold-down members (which frequently also act as separation pawls for separating and supplying the sheets one by one), the setting of the sheet size can easily be effected.

In addition, since the operation method is printed on the separation sheet, it is not required that an additional label on which the operation method is printed be adhered to the sheet containing cassette. Accordingly, the manufacturing cost can be reduced. The printed contents on the separation sheet is easy to see in comparison with sketches pictured on a stepped portion of a molded part, thereby improving usability. Further, the material of the separation sheet according to the illustrated embodiment has excellent durability.

The image forming apparatus including such a sheet containing cassette has reduced cost and good operability, and can handle various sheets having different sizes.

Incidentally, the sheet hold-down members are not limited to the illustrated ones. Alterations of the sheet hold-down member are shown in FIGS. 7 and 8.

Figure 7:
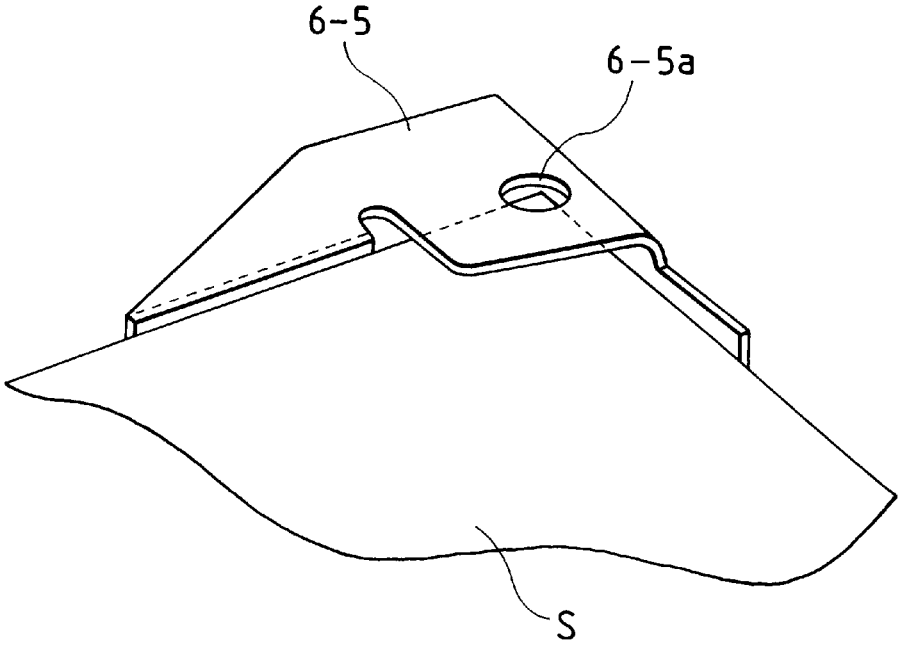
FIG. 7 is a perspective view showing an alteration of a sheet hold-down member.

A sheet hold-down member 6-5 shown in FIG. 7 also acts as a separation pawl. The sheet hold-down member 6-5 is provided with a hole 6-5*a* at a position corresponding to a corner position of the sheet stack set at the proper position, so that the corner position of the sheet stack can be indicated by the configuration of the sheet hold-down member 6-5 itself.

Figure 8:
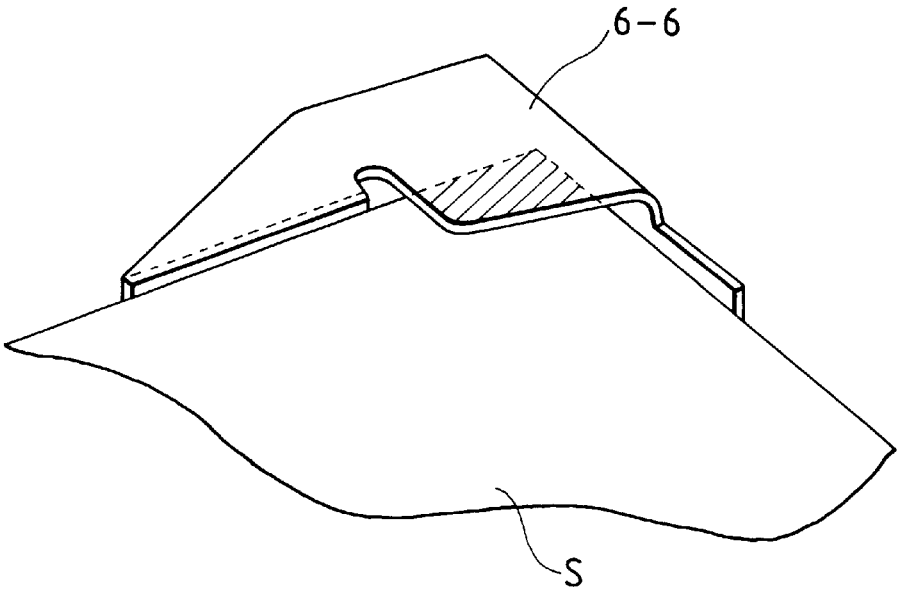
FIG. 8 is a perspective view showing a further alteration of a sheet hold-down member.

In a sheet hold-down member 6-6 shown in FIG. 8, a color on a hatched area (corresponding to a corner position of the sheet stack set at the proper position) is differentiated from a color on an adjacent surrounding area, thereby providing a mark. The mark represented by the color (or coloring) has excellent cognitive faculty to facilitate end user's operation. Such a mark can easily be obtained by painting. Incidentally, the marks 6-1*a*, 6-2*a* in the illustrated embodiment are represented by unevenness on the surfaces of the sheet hold-down members such as the stamping or marked lines.

What is claimed is:

1. A sheet containing cassette detachably mountable on a main body of an image forming apparatus to contain sheets to be supplied by a sheet supply means provided in said main body, the cassette comprising:

a frame member;

a sheet supporting member, having a surface on which the sheets are stacked, disposed within said frame member to support the sheets to be supplied by said sheet supply means; and a separation sheet formed from a material having a high coefficient of friction to the sheet and adhered to the surface of said sheet supporting member in an opposed relation to said sheet supply means for assisting supply of the sheet effected by said sheet supply means;

wherein a character and/or a sketch are described on said separation sheet.

2. A sheet containing cassette according to claim 1, wherein the character and/or the sketch described on said separation sheet indicate an operation method for loading the sheets on said sheet supporting member.

3. A sheet containing cassette according to claim 1, wherein said separation sheet is formed from transparent or translucent material, and the character and/or the sketch are described on a surface of said separation sheet opposite to a surface thereof opposed to said sheet supply means.

4. A sheet containing cassette according to claim 3, wherein said separation sheet is formed from material including elastomer.

5. A sheet containing cassette according to claim 3, wherein said separation sheet is formed from material including elastomer of urethane group.

6. A sheet containing cassette according to one of claims 1 to 5, wherein a grain is formed on the surface of said separation sheet opposed to said sheet supply means.

7. A sheet containing cassette according to claim 1, wherein said sheet supporting means is a plate-shaped member rockably attached to said frame member to support a sheet stack, and a biasing means for biasing said sheet supporting means toward said sheet supply means is provided between said sheet supporting means and said frame member.

8. A sheet containing cassette according to claim 7, further comprising a position regulating member for regulating an upper surface of the sheet stack to a predetermined level by abutting against an upper surface of a corner of the sheet stack, and wherein said position regulating member is provided with a display for indicating a position of the corner of the sheet stack supported by said sheet supporting means.

9. A sheet containing cassette according to claim 8, wherein said display is formed on a surface of said position regulating member as unevenness.

10. A sheet containing cassette according to claim 8, wherein said display is formed by coloring.

11. A sheet containing cassette according to one of claims 8 to 10, wherein said position regulating member constitutes a separation pawl for separating the sheets one by one when the sheets are fed out by said sheet supply means.

12. An image forming apparatus to which is detachably mounted a sheet containing cassette containing sheets to be supplied by a sheet supply means, said sheet containing cassette comprising:

a frame member;

a sheet supporting member, having a surface on which the sheets are stacked, disposed within said frame member to support the sheets to be supplied by said sheet supply means; and a separation sheet formed from a material having a high coefficient of friction to the sheet and adhered to the surface of said sheet supporting member in an opposed relation to said sheet supply means for assisting supply of the sheet effected by said sheet supply means;

wherein character and/or a sketch are described on said separation sheet.

* * * * *

UNITED STATES PATENT AND TRADEMARK OFFICE

CERTIFICATE OF CORRECTION

PATENT NO. : 6,338,585 B1
DATED : January 15, 2002
INVENTOR(S) : Masao Amano

It is certified that error appears in the above-identified patent and that said Letters Patent is hereby corrected as shown below:

Title page,
Item [56], References Cited, U.S. PATENT DOCUMENTS, "6,065,586 5/2000 Embry et al." should read -- 6,065,886 5/2000 Embry et al. --.

Column 1,
Line 23, "has also been" should be deleted.
Line 24, "required" should be deleted.

Signed and Sealed this

Second Day of July, 2002

*Attest:*

*Attesting Officer*

JAMES E. ROGAN
*Director of the United States Patent and Trademark Office*